US007326103B2

(12) United States Patent
Sakurai et al.

(10) Patent No.: US 7,326,103 B2
(45) Date of Patent: Feb. 5, 2008

(54) VERTICALLY ADJUSTABLE CHEMICAL MECHANICAL POLISHING HEAD AND METHOD FOR USE THEREOF

(75) Inventors: Kunihiko Sakurai, San Jose, CA (US); Gerard Moloney, Milpitas, CA (US); Huey-Ming Wang, Fremont, CA (US); Jun Liu, Cupertino, CA (US); Peter Lao, San Jose, CA (US)

(73) Assignee: Ebara Technologies Incorporated, Sacramento, CA (US)

( * ) Notice: Subject to any disclaimer, the term of this patent is extended or adjusted under 35 U.S.C. 154(b) by 48 days.

(21) Appl. No.: 10/700,984

(22) Filed: Nov. 4, 2003

(65) Prior Publication Data

US 2004/0121704 A1 Jun. 24, 2004

Related U.S. Application Data

(60) Provisional application No. 60/425,125, filed on Nov. 7, 2002.

(51) Int. Cl.
*B24B 49/00* (2006.01)

(52) U.S. Cl. ..... 451/10; 451/11; 451/21; 451/41; 451/288; 451/398; 156/345.13; 156/345.14

(58) Field of Classification Search ..... 451/41, 451/285, 287, 288, 289, 398, 11, 21, 10; 156/345.13, 345.14
See application file for complete search history.

(56) References Cited

U.S. PATENT DOCUMENTS

| | | | | |
|---|---|---|---|---|
| 5,964,653 | A * | 10/1999 | Perlov et al. | 451/288 |
| 6,113,479 | A * | 9/2000 | Sinclair et al. | 451/288 |
| 6,179,956 | B1 * | 1/2001 | Nagahara et al. | 156/345.14 |
| 6,220,930 | B1 * | 4/2001 | Lin et al. | 451/8 |
| 6,277,009 | B1 * | 8/2001 | Chen et al. | 451/288 |
| 6,540,590 | B1 * | 4/2003 | Kajiwara et al. | 451/41 |
| 6,579,151 | B2 * | 6/2003 | Tseng et al. | 451/11 |
| 6,641,461 | B2 * | 11/2003 | Wang et al. | 451/41 |
| 6,705,923 | B2 * | 3/2004 | Liu et al. | 451/7 |
| 6,716,094 | B2 * | 4/2004 | Shendon et al. | 451/288 |
| 6,796,887 | B2 * | 9/2004 | Marquardt | 451/286 |
| 6,835,125 | B1 * | 12/2004 | Tseng et al. | 451/398 |
| 6,872,130 | B1 * | 3/2005 | Zuniga | 451/287 |
| 6,893,327 | B2 * | 5/2005 | Kajiwara et al. | 451/41 |
| 7,217,175 | B2 | 5/2007 | Togawa | |
| 2003/0060127 | A1 * | 3/2003 | Kaushal et al. | 451/8 |
| 2004/0033760 | A1 * | 2/2004 | Osterheld | 451/8 |

FOREIGN PATENT DOCUMENTS

| | | | |
|---|---|---|---|
| WO | WO 01/87541 | A2 | 11/2001 |
| WO | WO 2004/041479 | A1 | 5/2004 |

* cited by examiner

*Primary Examiner*—Eileen P. Morgan
(74) *Attorney, Agent, or Firm*—Squire Sanders & Dempsey LLP

(57) ABSTRACT

The invention provides a vertically adjustable chemical mechanical polishing head having a pivot mechanism and method for use thereof.

24 Claims, 9 Drawing Sheets

Section B - B

Section C - C

Section D - D

VERTICALLY ADJUSTABLE CHEMICAL MECHANICAL POLISHING HEAD AND METHOD FOR USE THEREOF

PRIORITY REFERENCE TO PRIOR APPLICATIONS

This application claims benefit of and incorporates by reference U.S. patent application Ser. No. 60/425,125, entitled "Polishing Head Having a Pivot Mechanism," filed on Nov. 7, 2002, by inventors Kunihiko Sakurai et al.

TECHNICAL FIELD

This invention relates generally to chemical mechanical polishing (CMP), and more particularly, but not exclusively, provides a chemical mechanical polishing apparatus having a pivot mechanism and method for use thereof.

BACKGROUND

CMP is a combination of chemical reaction and mechanical buffing. A conventional CMP system includes a polishing head with a retaining ring that holds and rotates a substrate (also referred to interchangeably as a wafer) against a pad surface rotating in the opposite direction or same direction. The pad can be made of cast and sliced polyurethane (or other polymers) with a filler or a urethane coated felt.

During rotation of the substrate against the pad, a slurry of silica (and/or other abrasives) suspended in a mild etchant, such as potassium or ammonium hydroxide, is dispensed onto the pad. The combination of chemical reaction from the slurry and mechanical buffing from the pad removes vertical inconsistencies on the surface of the substrate, thereby forming an extremely flat surface.

However, conventional CMP systems have several shortcomings including process instability that can lead to inconsistent polish profiles of substrates; table-to-table and tool-to-tool variation that can lead to inconsistent polish profiles of substrates processed on different CMP systems; and process optimization difficulties that make it difficult to balance pressure within air-pressurized chambers due to a plurality of pressure controllers.

FIG. 1A is a block diagram illustrating a cross section of a prior art polishing head 100 that exhibits the above-mentioned deficiencies. A retaining ring 125 is cylindrical in shape and holds a substrate 120 (also referred to as a wafer) in place during CMP. An air pressure/force balancing method, as indicated by the arrows in FIG. 1A, is used to maintain a downward pressing force against a shaft and the substrate 120 during CMP. In addition, to prevent a plate 140 from ballooning out of the polishing head 100, supplied pressure exerts an upward force.

However, these above-mentioned forces are subject to process instability, which can lead to inconsistent polish profiles of substrates. Specifically, the above-mentioned forces are each powered by air pressure administered by air pressure controllers. The controllers each have their own tolerances that can lead to errors in the amount of air pressure applied. For example, if the pressure in region 105 is greater than the pressure in region 115, the plate 140 is placed in a position that is lower than expected. A rubber insert 130 is formed as shown in FIG. 1B (and is different from FIG. 1C when the plate 140 is placed in the expected position). In the condition shown in FIG. 1B, the plate 140 compresses the edge of rubber insert 130 due to the pressure difference between region 105 and 115. This compressing force gives a pressure on the edge of the substrate 120 that is different from a pressure on the other region provided by air pressure in region 115. As a result, excess pressure is applied on an edge of the substrate 120 and it increases a polishing rate of the substrate 120.

Further, there can be additional variation between conventional CMP systems that lead to inconsistent profiles between substrates. In addition, it can be hard to optimize the process in conventional CMP systems so that the forces required are adequately and consistently balanced.

Another shortcoming of conventional CMP systems is that CMP heads always get lowered to the same position even though the pads wear down over time. This can lead to the insufficient polishing of substrates.

Therefore, a system and method are needed that overcome the above-mentioned deficiencies.

SUMMARY

The invention provides a chemical mechanical polishing head and a method of use thereof. In one embodiment, the chemical mechanical polishing head comprises a substrate holding head and a motor. The motor is coupled to the head and is capable of positioning the head vertically to compensate for pad wear.

In an embodiment of the invention, the method comprises placing a substrate in a chemical mechanical polishing head for polishing and positioning the head to compensate for pad wear.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

The following description is provided to enable any person of ordinary skill in the art to make and use the invention, and is provided in the context of a particular application and its requirements. Various modifications to the embodiments will be readily apparent to those skilled in the art, and the principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1A:
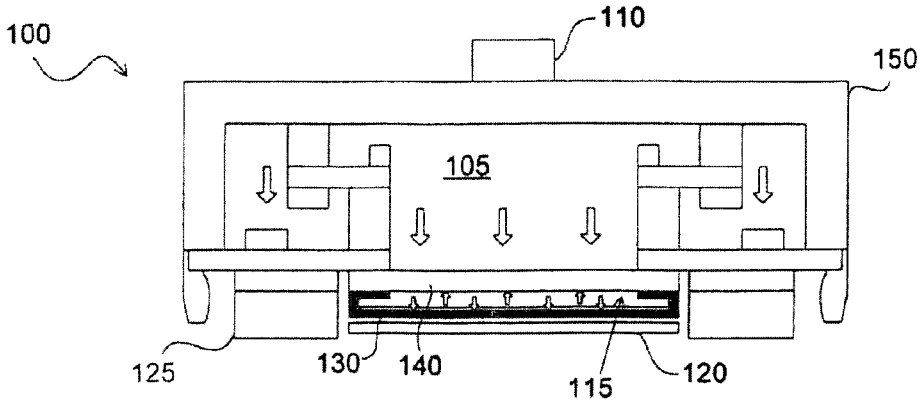
FIG. 1A Prior Art
FIG. 1A is a block diagram illustrating a cross section of a prior art polishing head.
Figure 1B:
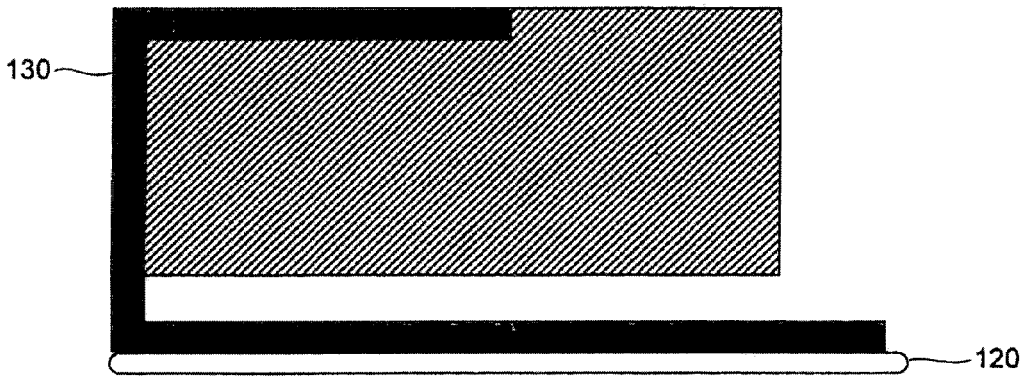
FIG. 1B Prior Art
FIG. 1B and FIG. 1C are diagrams illustrating a portion of the prior art polishing head an uncompressed and a compressed state, respectively.
Figure 1C:
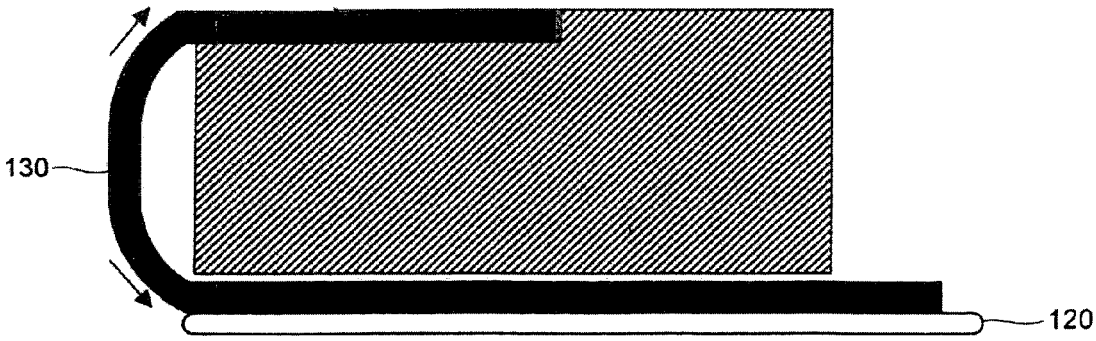
FIG. 1C Prior Art
Figure 2:
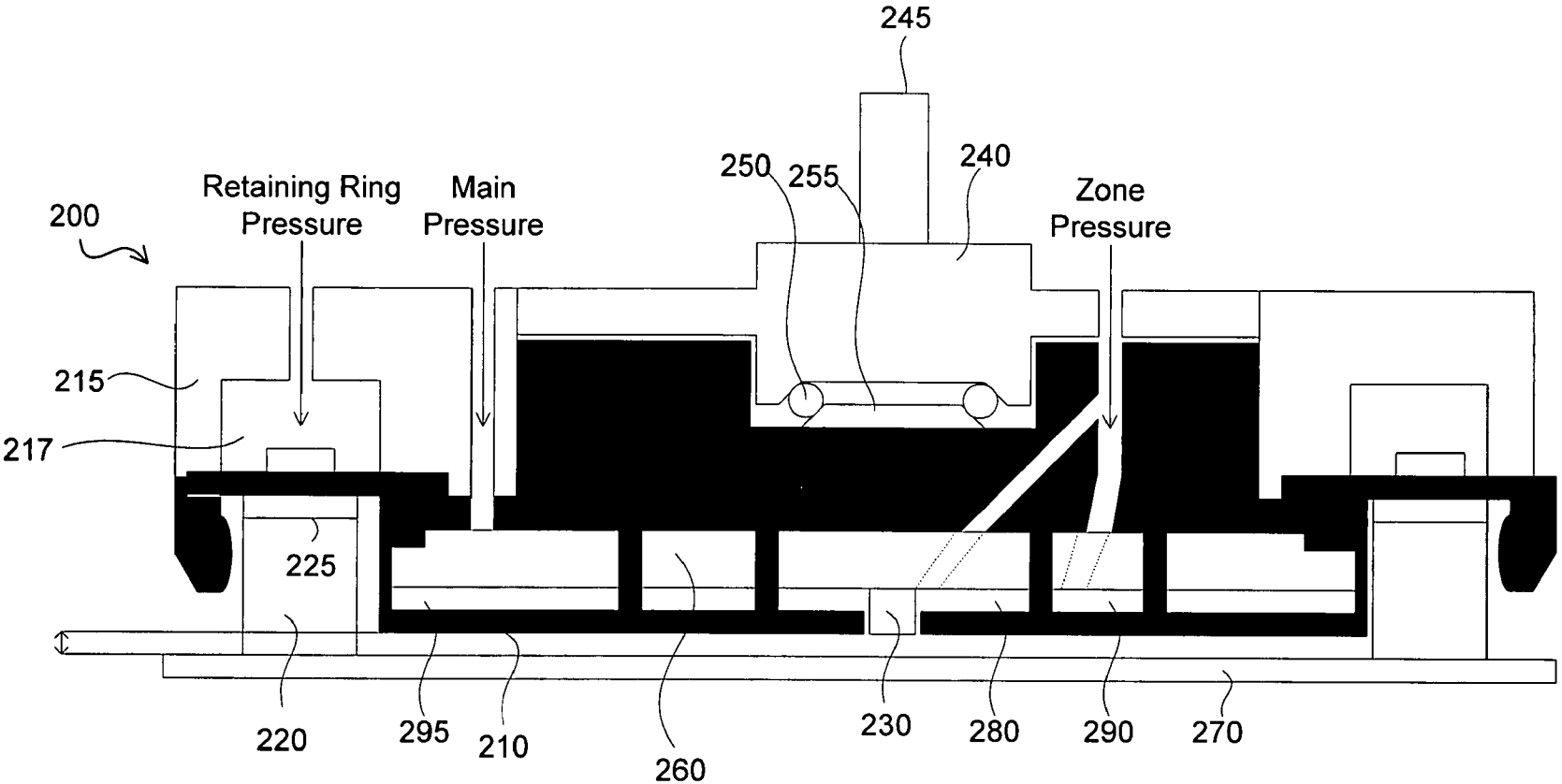
FIG. 2 is a block diagram illustrating a cross section of polishing head according to an embodiment of the invention.

FIG. 2 is a block diagram illustrating a cross section of polishing head 200 according to an embodiment of the invention. The polishing head 200 includes an upper housing 215, retaining ring 220; retaining ring adapter 225; drive flange 240; shaft 245; ball bearings 250; dome 255; sub carrier 260; rubber insert 210; and reference point 230.

The retaining ring 220 is cylindrical in shape and retains a substrate during CMP. The retaining ring 220 has an inner diameter of at least about 200 mm to about 203 mm for a 200 mm substrate or at least 300 mm to about 303 mm for a 300 mm substrate. The retaining ring 220 has an outer diameter of about 230 mm to about 275 mm for a 200 mm substrate or about 330 mm to 375 mm for a 300 mm substrate. The retaining ring 220 is coupled to the upper housing 215 via a diaphragm (not shown) and the retaining ring adapter 225, which has inner and outer diameters substantially similar to the inner and outer diameters of the retaining ring 220.

The drive flange 240 has a bottom surface that is pivotally coupled to the dome 255 via the ball bearings 250. The dome 255 is coupled to a base flange (not shown). The base flange is also coupled to the sub carrier 260 and rubber insert 210. The reference point 230 is attached on the sub carrier 260 and can have a soft pad on the bottom thereof.

The shaft 245 extends upwards from the drive flange 240 and is cylindrical in shape. The ball bearings 250 comprise a plurality of ceramic balls, each having a diameter of about 5/16 of an inch. In an embodiment of the invention, the ball bearings 250 include fifteen ceramic balls. The dome 255 is dome shaped with a flat top.

The sub carrier 260 is cylindrical in shape and has a diameter about equal to the diameter of a substrate (e.g., about 200 mm or about 300 mm). The reference point 230 is also cylindrical in shape and can have a diameter of just a few millimeters. The rubber insert 210 forms several air pressure zones or chambers, such as zones 280, 290, and 295, by walling off volume between the rubber insert 210 and the sub carrier 260.

During CMP, the retaining ring 220 retains a substrate for processing. Pressure is then applied to the drive flange 240 forcing the polishing head 200 downwards until a bracket 950 contacts a stopper assembly 945 (FIG. 9). Controllable retaining ring air pressure is then supplied to a zone 217 to force the retaining ring 220 downwards. Controllable main air pressure is also supplied to zone 295. Additional controllable zone air pressure can also be supplied to zones 280 and 290. The main pressure and zone air pressure act to press the rubber insert 210 against a substrate thereby forcing the substrate to interact with the polishing pad 270 during CMP. Further, the main pressure and zone pressure place upward pressure on the sub carrier 260.

A pivot mechanism (comprising the ball bearings 250) enables the pivoting of the polishing head 200 based on the main pressure and zone pressure. If the shaft 245 is not assembled vertical to the polishing pad 270, the pivot mechanism enables the polishing head 200 to align parallel to the polishing pad 270. The polishing head 200 can hang a short distance from the drive flange 240 via 3 springs and 3 pins. Once the polishing head 200 is placed on the polishing pad 270 and pressure is applied on the retaining ring 220 and the back side of the wafer, the upper housing 215 receives upward force through the base flange (not shown), which is enough to push up the whole polishing head assembly 200 until the dome 255 on the top of the polishing head 200 contacts the ball bearings 250 coupled to the drive flange 240 so that the polishing head 200 can pivot and align in parallel with the polishing pad 270. Accordingly, the sub carrier 260 and the insert 210 can keep the same vertical position at each polishing.

Figure 3:
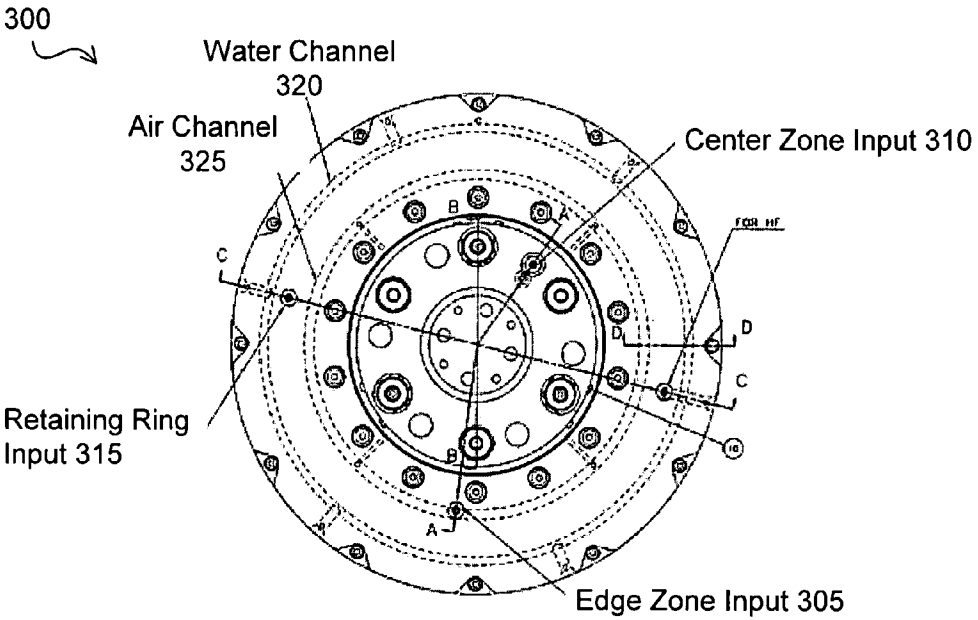
FIG. 3 is a top view illustrating a polishing head according to an embodiment of the invention.

FIG. 3 is a top view of a polishing head 300 according to an embodiment of the invention. The polishing head 300 is cylindrical in shape with an outer diameter of about 250 mm for 200 mm substrates or about 350 mm for 300 mm substrates. Different cross-sections of the polishing head 300 will be discussed in further detail in conjunction with FIG. 4, FIG. 5, FIG. 6., and FIG. 7.

Figure 6:
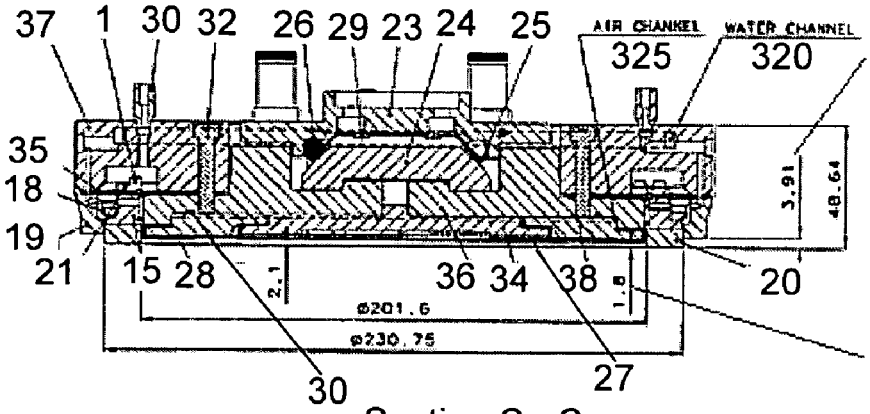
FIG. 6 is a third cross section illustrating the polishing head of FIG. 3.

The polishing head 300 comprises a plurality of air pressure inputs, including a center zone input 310; an edge zone input 305; and a retaining ring input 315. The polishing head 300 also comprises an air channel 325 and a water channel 320. The air pressure inputs 305, 310 and 315 each independently supply controllable air pressure to different zones within the polishing head 300. The retaining ring input 315 supplies air pressure to a retaining ring zone so as to apply downward pressure on a retaining ring 20 (FIG. 6) during CMP. The center zone input 310 supplies air pressure to a center zone within the polishing head 300 that is formed by an inner rubber insert 27 (FIG. 6) and a sub carrier 38 (FIG. 6). The edge zone input 305 supplies air pressure to the air channel 325, which is in communication with an edge zone that is formed by an outer rubber insert 28 (FIG. 6) and the sub carrier 38.

Figure 4:
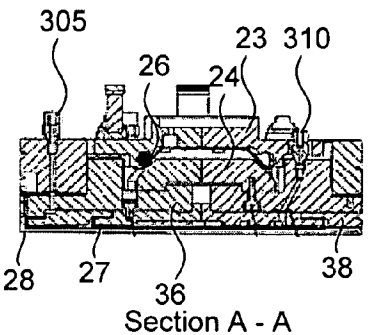
FIG. 4 is a cross section illustrating the polishing head of FIG. 3.

FIG. 4 is a cross section illustrating the polishing head 300 of FIG. 3. The cross section illustrates a flange drive 23; a dome 24; ball bearings 26; an inner rubber insert 27; an outer rubber insert 28; a base flange 36; and a sub carrier 38. The dome 24 is pivotly coupled to the flange drive 23 via the ball bearings 26. The flange drive 23 is also cylindrically shaped and pressure applied to the top of the flange drive 23 forces the polishing head 300 in a downward direction. The base flange 36 is cylindrical in shape and is coupled to the bottom of the dome 24.

The inner rubber insert 27 and outer rubber insert 28 are coupled to the sub carrier 38, which in turn is coupled to the base flange 36, thereby enabling the inserts 27 and 28 to pivotly contact a substrate being acted upon by the polishing head 300. The sub carrier 38 is disk shaped and in conjunction with the inserts 27 and 28 form the center zone and edge zone described above. Pressure is supplied to the center zone and edge zone via the center zone input 310 and edge zone input 305, respectively.

Figure 5:
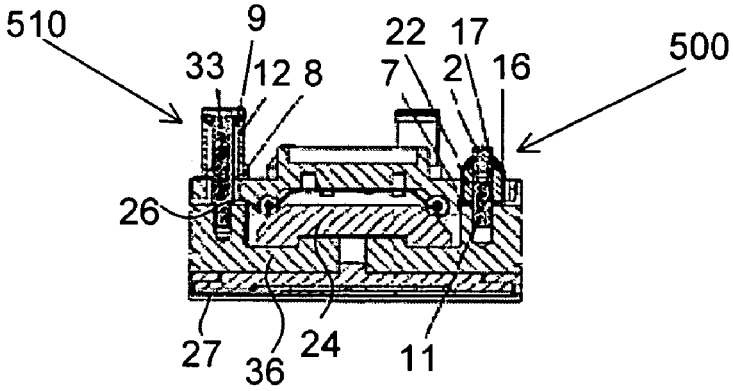
FIG. 5 is a second cross section illustrating the polishing head of FIG. 3.

FIG. 5 is a second cross section illustrating the polishing head 300 of FIG. 3. The cross section of FIG. 5 illustrates the coupling of the base flange 36 to the flange drive 23 via two assemblies 500 and 510. The first assembly 500 comprises a collar 16; a cap 17; a screw 2; a rubber cushion 22; a washer 7 and a pin 11. The pin 11 is circumscribed by the collar 16 and topped with the cap 17. In addition, the rubber cushion 22 is located between the pin 11 and the collar 16 so as to cushion the interface between the pin 11 and the collar 16. The washer 7 is located at the interface between the base flange 36 and flange drive 23 and circumscribes the pin 11. The first assembly 500 enables the polishing head 300 to transfer torque when the shaft rotates the flange drive 23.

The second assembly 510 comprises a washer 8; a spring 12; a washer 9; and a screw 33. The screw 33 couples the base flange 36 to the flange drive 23. The spring 12 circumscribes the screw 33 and enables rebound of the base flange 36 due to pivoting. The second assembly 510 also includes the washers 8 and 9 that are located at the top of the screw 33 and at the interface between the diaphragm support ring alpha gimbal 36 and the flange drive 23. The second assembly 510 enables the head 300 to hang from the flange drive 23. It will be appreciated by one of ordinary skill in the art that the polishing head 300 can include additional assemblies that are substantially similar to the first assembly 500 and/or second assembly 510. For example, in an embodiment of the invention, the polishing head 300 includes three assemblies substantially similar to the first assembly 500 and three assemblies substantially similar to the second assembly 510.

FIG. 6 is a third cross section illustrating the polishing head 300 of FIG. 3. Components of the polishing head 300 that are visible in this cross section include an upper housing 37; a seal ring 1; a tube 30; a screw 32; the ceramic balls 25; a cross flat countersunk 29; the flange drive 23; the dome adapter 24; the ball holder drive flange 25; a retaining ring 20; the sub carrier 38; the inner rubber insert 27; an inner diaphragm support 34; the diaphragm support ring alpha gimbal 36; the outer rubber insert 28; the adapter 15; a stop ring 21; a lower housing 19; a stopper 18; and a primary diaphragm 35.

The retaining ring 20 is ring shaped and retains a substrate during CMP. The retaining ring 20 also circumscribes the disc shaped sub carrier 38. Downward pressure is applied to the retaining 20 to place the retaining ring 20 in contact with a polishing pad via the retaining ring input 315 (e.g., tube 30).

The retaining ring 20 is coupled to the diaphragm 35 with a seal ring 1 so as to bind the diaphragm 35. The outer edge of the diaphragm 35 is bounded by the upper housing 37 the lower housing 19, the inner edge of the diaphragm 35 is bounded by the upper housing 37 and the base flange 36, thereby forming a cylindrical chamber capable of receiving pressurized air so that the retaining ring 20 can exert a downward pressure against the polishing pad.

Figure 7:
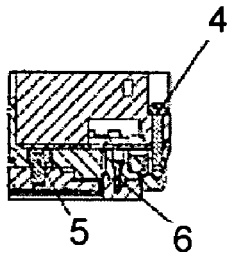
FIG. 7 is a fourth cross section illustrating the polishing head of FIG. 3.

During CMP, pressure is supplied against the retaining ring 20 in the retaining ring zone, to the center zone and to the edge zone. The pressures in the center zone and edge zone push the inner rubber insert 27 and outer rubber insert 28 downward against the substrate, causing the substrate to interact with the polishing pad. The pressure in the chambers gives the upward force against the dome 24 via relative parts. Accordingly, the dome 24 contacts the drive flange 23 during polishing. Further, the head is enabled to pivot during polishing as a result of the dome and the drive flange 23. FIG. 7 is a fourth cross section illustrating the polishing head 300 of FIG. 3.

Figure 8:
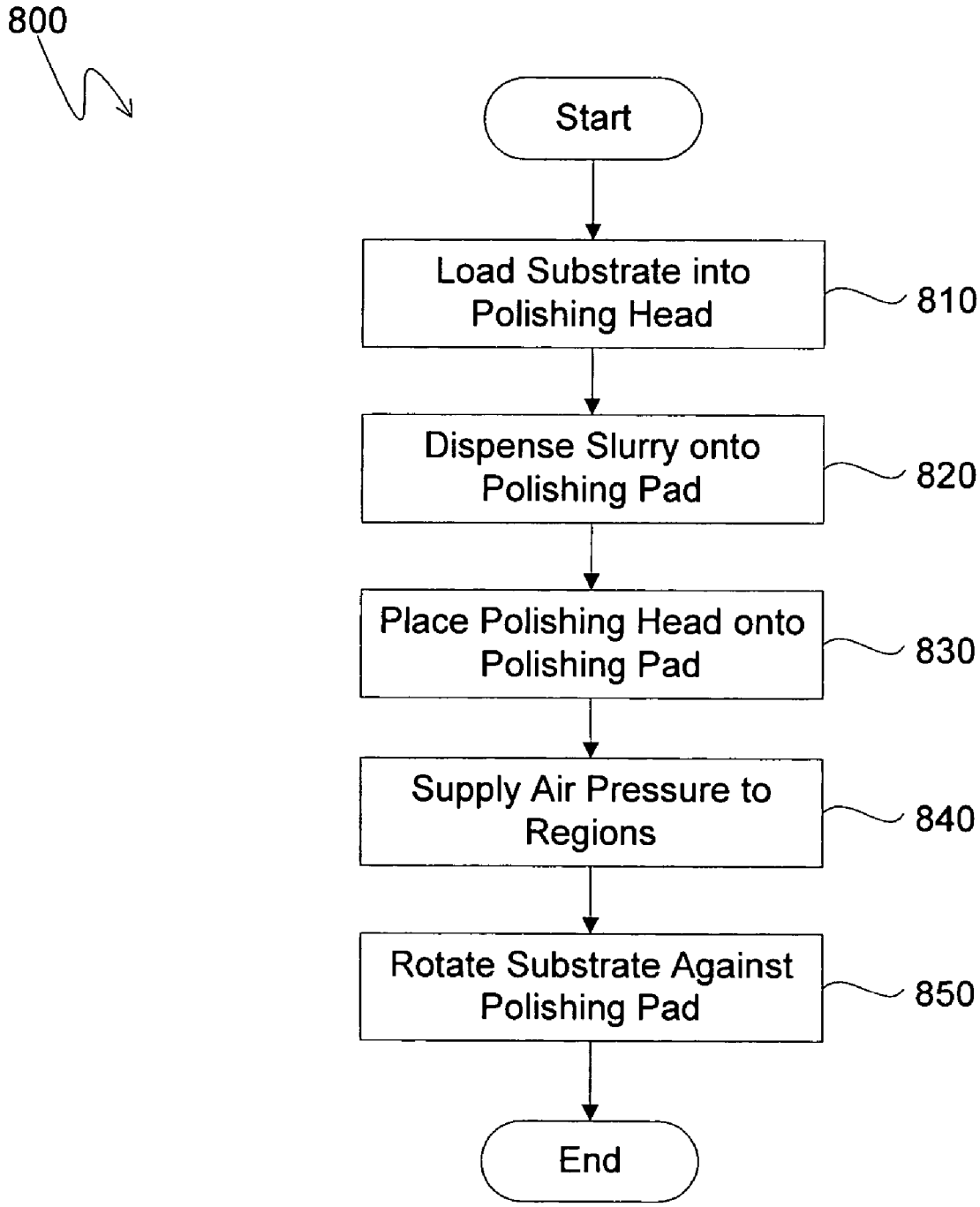
FIG. 8 is a flowchart illustrating a method of chemical mechanical polishing.

FIG. 8 is a flowchart illustrating a method 800 of chemical mechanical polishing. First, a substrate for polishing is loaded (810) into a polishing head, such as polishing head 200 or 300, for polishing. After the substrate has been loaded (810), a slurry is dispensed (820) onto the polishing pad. The slurry can include silica (and/or other abrasives) suspended in a mild etchant, such as potassium or ammonium hydroxide. The polishing head is then placed (830) on the polishing pad.

Air pressure is supplied (840) to the various zones of the polishing head. For example, air can be supplied to zones 217 and 295 of the polishing head 200. After supplying (840) air pressure, the substrate is rotated (850) against the polishing pad. The combination of chemical reaction from the slurry and mechanical buffing from the pad removes vertical inconsistencies on the surface of the substrate, thereby forming an extremely flat surface.

It will be appreciated that the supplying (840), dispensing (820), and rotating (850) and placing (830) can be performed in an order different from that described above. In addition, it will be appreciated that the dispensing (820), the supplying (840) and the rotating (850) call all be performed substantially simultaneously.

FIGS. 9A-9D are block diagrams illustrating a polishing system 900 incorporating a height-adjustable head. The system 900 includes the head 200 coupled to a cylindrical shaft 930, which travels through a support arm 940. A mounting assembly 910 is fixed to the shaft 930 and to a sensor assembly 920. The support arm 940 has a stopper assembly 945 located on a top of the support arm 940 adjacent and parallel to the shaft 930. The stopper assembly 945 is located on the support arm 940 in a position that is directly below the sensor assembly 920 so that the sensor assembly 920 has a direct unobstructed view of the stopper assembly 945.

Figure 9A:
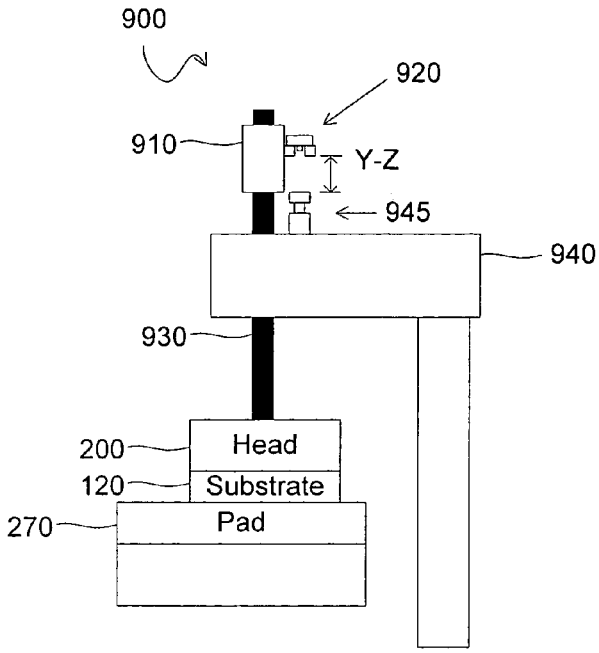
FIGS. 9A-9D are block diagrams illustrating a polishing system incorporating a height-adjustable head.
Figure 9B:
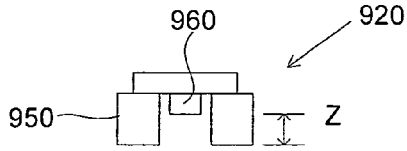

The sensor assembly 920, as shown in more detail in FIG. 9B, includes a sensor 960 surrounded by a bracket 950. The sensor 960 can include an IR range finder or other sensor (e.g., ultrasound) capable of determining a distance between the sensor 960 and the top of the stopper assembly 945. The sensor 960 is recessed a distance Z within the bracket 950 so as to protect the sensor 960 from damage when the sensor assembly is in contact with the stopper assembly 945, as will be discussed in further detail below in conjunction with the FIG. 10. In an embodiment of the invention, Z is equal to about 10 mm.

Figure 9C:
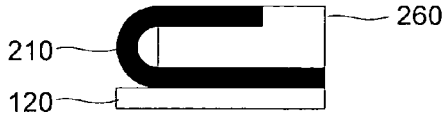

The stopper assembly 945 includes a stopper coupled to a servomotor (not shown) that is located within the support arm 940. The servomotor moves the stopper in a vertical direction from a low position, as shown in FIG. 9A up to a height of Y−Z+X above the low position. The servomotor can also move the head 200 in a vertical direction. Y is the distance between the sensor 960 and the stopper when the head 200 is positioned to compress the insert 210 against the sub carrier 260 as shown in FIG. 9C. The value of Y decreases slightly after each substrate 120 polishing due to pad wear. For example, Y can decrease by about 0.3 μm to up to about 10.0 μm per substrate 120 polishing. Depending on the sensitivity of the servomotor, Y can be measured after every CMP process or after a certain number of intervals. For example, if the servomotor is capable of raising the stopper to a position with an accuracy of 50 μm, then Y can be calculated after every 10 to 50 CMP processes.

Figure 9D:
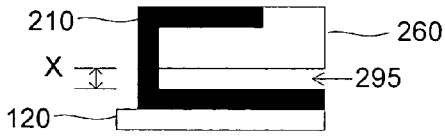

X is the distance between the sub carrier 260 and the insert 210 during polishing as shown in FIG. 9D, i.e., the height of the zone 295. In an embodiment of the invention, X is equal to about 0.5 mm.

It will be appreciated by one of ordinary skill in the art that the system 900 can use different polishing heads, such as heads 100 or 300.

Figure 10:
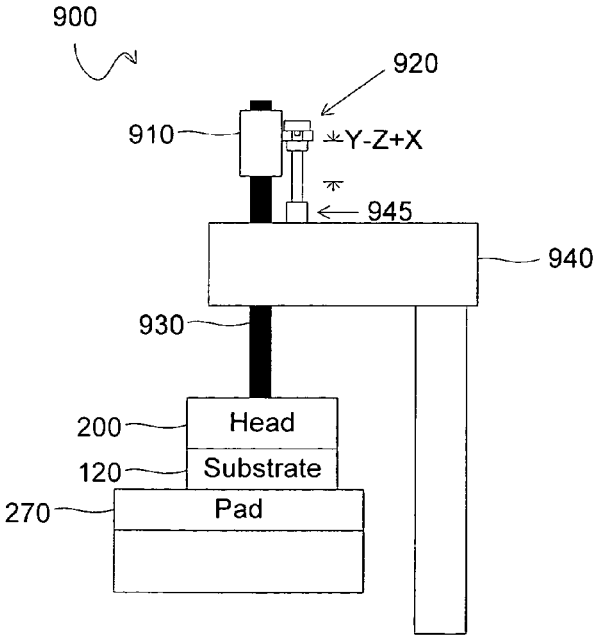
FIG. 10 is a block diagram illustrating the polishing system of FIG. 9A in an uncompressed state.

FIG. 10 is a block diagram illustrating the polishing system 900 in an uncompressed state, i.e., in position for CMP. After the sensor 960 measures Y, the head 200 is raised so that the bottom of the sensor assembly 920 is positioned at a height above the stopper assembly 945 equal to Y−Z+X. The servomotor then raises the stopper so that the top of the stopper is located at Y−Z+X above the original lowered stopper position. The head 200 is then lowered, if necessary, to a CMP position until the sensor assembly 920 contacts the stopper. It will be appreciated that a CMP position can be obtained by adjusting the vertical position by a servo motor without using a stopper. Also, vertical distance will be measured by a pulse signal from the servo motor instead of using the sensor.

In an embodiment of the invention, the head 200 can be lowered to different heights during different steps of the CMP. For example, where total polishing time is set to 100 seconds and comprises three different polishing sequences at different heights, the first could be set for 30 seconds with polishing condition A, the second could move to polishing condition B for 60 seconds and the last to polishing condition C for 10 seconds. In a Cu circuit process, Cu metal is first removed on the circuit and then a barrier metal below the Cu is removed. The materials on both the Cu and the barrier layer are different and therefore use a different slurry and conditions for removing each material. Therefore, 2 or more different conditions (polishing step) are set in the Cu process. The vertical position of the polishing head is a parameter that determines polishing performance and needs to change between the Cu and barrier layer polishing steps. As a result, vertical position is not fixed in one position during whole polishing but fixed during each polishing step.

Figure 11:
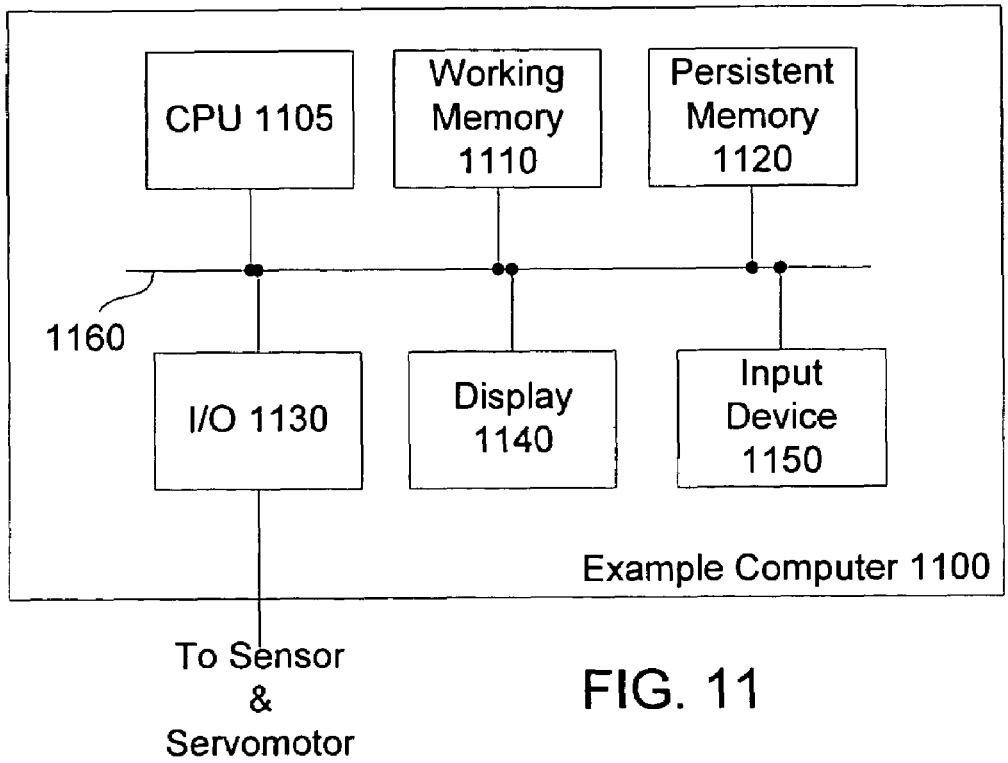
FIG. 11 is a block diagram illustrating an example computer capable of controlling the polishing system of FIG. 9A.

FIG. 11 is a block diagram illustrating an example computer 1100 capable of controlling the polishing system 900. The example computer 1100 can be located within the support arm 940 or at any other location and is communicatively coupled, via wired or wireless techniques, to the servomotor and to the sensor 960. Use of the computer 1100 to control the servomotor and the sensor 960 will be discussed further below in conjunction with FIG. 12. The example computer 1100 includes a central processing unit (CPU) 1105; working memory 1110; persistent memory 1120; input/output (I/O) interface 1130; display 1140 and input device 1150, all communicatively coupled to each other via a bus 1160. The CPU 1105 may include an INTEL PENTIUM microprocessor, a Motorola POWERPC microprocessor, or any other processor capable to execute software stored in the persistent memory 1120. The working memory 1110 may include random access memory (RAM) or any other type of read/write memory devices or combination of memory devices. The persistent memory 1120 may include a hard drive, read only memory (ROM) or any other type of memory device or combination of memory devices that can retain data after the example computer 1100 is shut off. The I/O interface 1130 is communicatively coupled, via wired or wireless techniques, to the sensor 960 and the servomotor. The display 1140, like other components of the computer 1100, is optional and may include a cathode ray tube display or other display device. The input device 1150, which is also optional, may include a keyboard, mouse, or other device for inputting data, or a combination of devices for inputting data.

One skilled in the art will recognize that the example computer 1100 may also include additional devices, such as network connections, additional memory, additional processors, LANs, input/output lines for transferring information across a hardware channel, the Internet or an intranet, etc. One skilled in the art will also recognize that the programs and data may be received by and stored in the system in alternative ways. Further, in an embodiment of the invention, an ASIC is used in placed of the computer 1100 to control the servomotor and the sensor 960.

Figure 12:
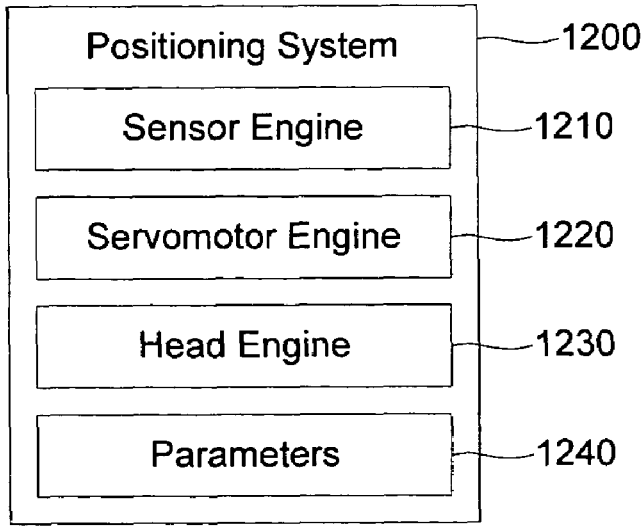
FIG. 12 is a block diagram illustrating a positioning system.

FIG. 12 is a block diagram illustrating a positioning system 1200, which can be resident on the example computer 1100. The positioning system 1200 communicates with the sensor 960 and the servomotor and controls movement of the sensor 960 and the head 200 via control of the servomotor. The positioning system 1200 includes a sensor engine 1210, a servomotor engine 1220, a head engine 1230, and a parameters file 1240. The sensor engine 1210 controls the sensor 960 including turning the sensor 960 on and off to get a distance reading. The servomotor engine 1220 controls the vertical movement of the stopper and the head 200 in response to calculations made by the head engine 1230. The head engine 1230 calculates the position the head 200 should be in for CMP based on readings from the sensor 960 and values stored in the parameters file 1240. The parameters file 1240 stores values X and Z. In an embodiment of the invention X and Z are equal to about 0.5 mm and 10 mm, respectively.

In an embodiment of the invention, the parameters file 1240 can also include a maximum Y value that corresponds with the maximum pad wear. The head engine 1230 can compare the measured Y value with the maximum Y value to determine if Y exceeds the maximum Y value. If the measured Y does exceed the maximum Y, the head engine 1230 can alert an operator of the system 900 that the pad 270 has exceeded the maximum pad wear and the operator can then replace the pad 270 with a new pad before initiating CMP.

In another embodiment of the invention, the parameters file 1240 includes pad wear rate data, which is calculated by measuring the difference in pad height between consecutive polishings. Alternatively, the pad wear data rate can be calculated by measuring the difference in pad height between a first polishing and a later polishing (e.g., $50^{th}$) and dividing the difference by the number of polishings between measurements. The parameters file 1240, in this embodiment, can also hold a head height for polishing when using a new polishing pad. Accordingly, depending on the sensitivity of the servomotor, the head engine 1230 can then use the pad wear rate data to recalculate the proposed position of the head 200 for every polishing after a pre-specified number of polishings. For example, the head position could be calculated as the original head height (when using a new polishing pad) less the pad wear rate times the number of polishings.

In another embodiment of the invention, the parameters file 1240 also stores vertical positioning information for different steps during a polishing process. For example, as described above, the head could be positioned at a first height for polishing Cu and then positioned at a second height for polishing a barrier layer.

Figure 13:
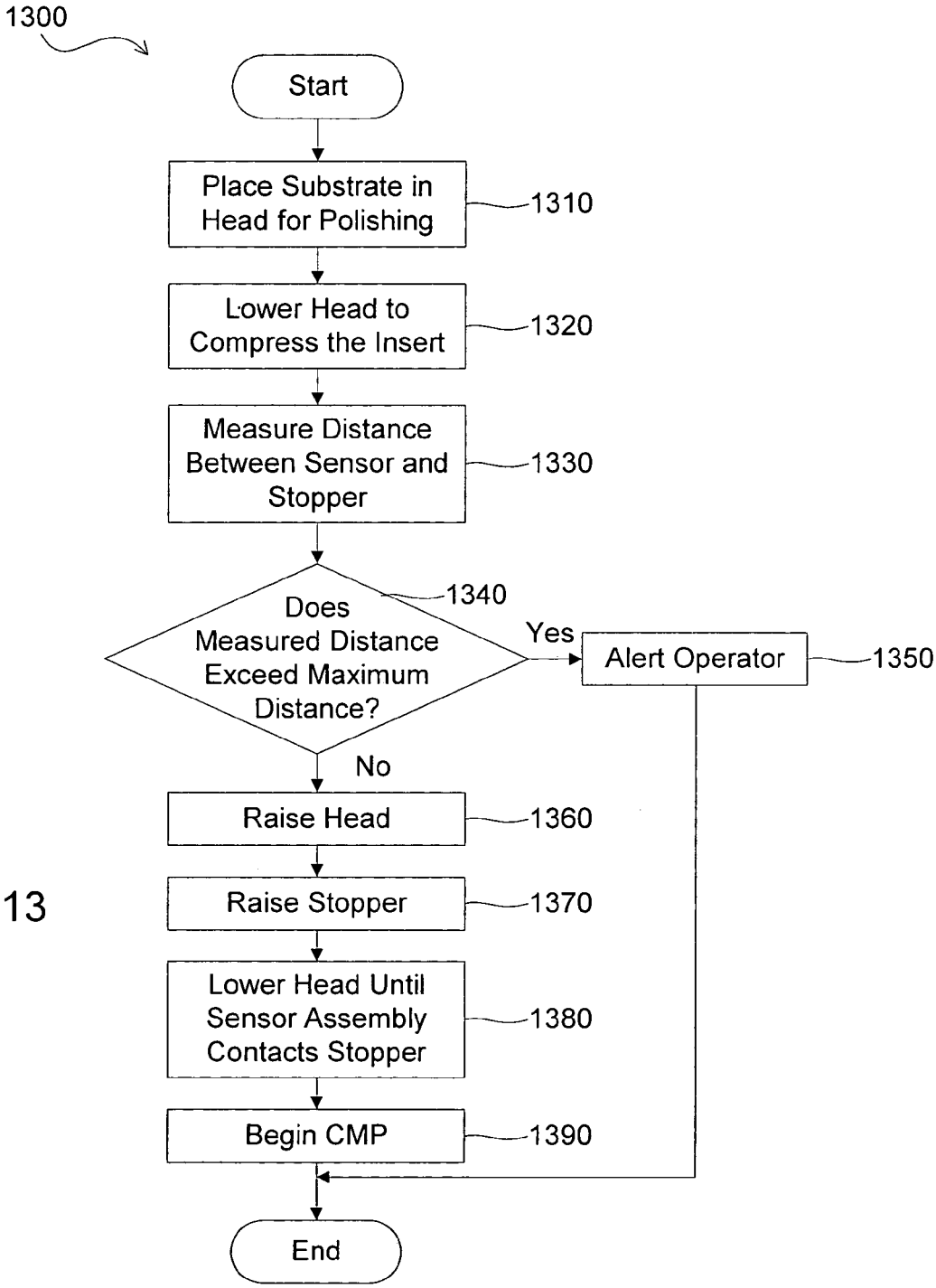
FIG. 13 is a flowchart illustrating a method of positioning a CMP head.

FIG. 13 is a flowchart illustrating a method 1300 of positioning a CMP head 200. First, a substrate 120 is placed (1310) in the head 200. Next, the head 200 is lowered (1320) so as to compress the sub carrier 260 against the insert 210. The distance is then measured (1330) between the sensor 960 and the top of the stopper assembly 945 to yield the value Y. It is then determined (1340) if the value Y exceeds a maximum Y value. If it does, then the operator is warned (1350) via aural, visual, tactile and/or other techniques that pad wear exceeds recommended amounts and the method 1300 ends. Otherwise, the head 200 is then raised (1360) and the stopper is raised (1370) to a height above its lowered position equal to Y−Z+X. The head 200 is then lowered (1380) until the sensor assembly 920 contacts the stopper assembly 945. CMP can then begin (1390). In an embodiment of the invention, CMP (1390) can comprise different steps that adjust the vertical position of the head 200 to polish different layers of the substrate 120. The method 1300 then ends.

Figure 14:
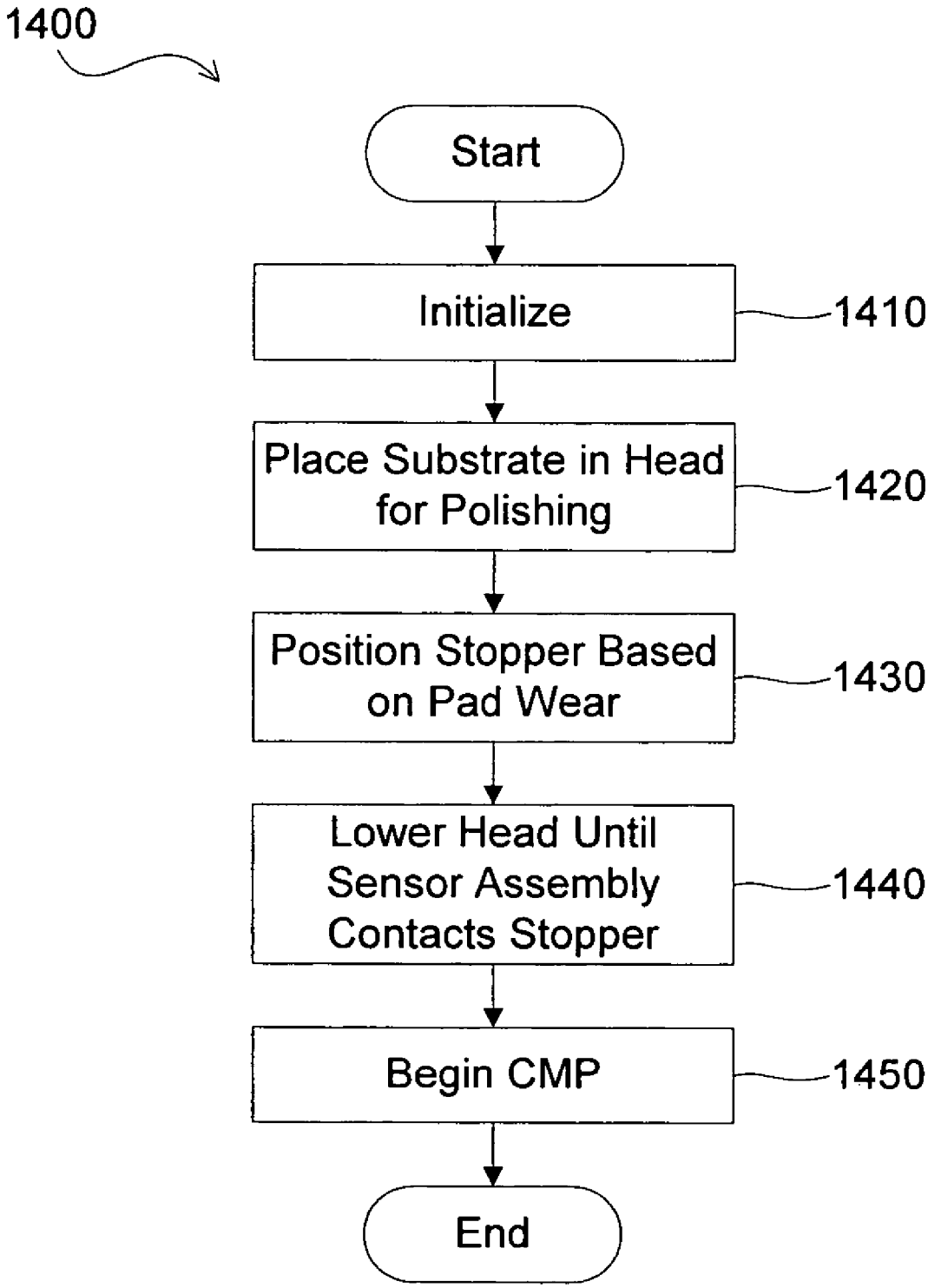
FIG. 14 is a flowchart illustrating a second method of positioning a CMP head.

FIG. 14 is a flowchart illustrating a second method 1400 of positioning a CMP head 200. First, the system is initialized (1410), which can include calculating a pad wear rate and determining the compressibility of the head (i.e., the distance X). The pad wear rate can be calculated by measuring the difference in pad height between consecutive polishings. Alternatively, the pad wear rate can be calculated by measuring the difference in pad height between a first polishing and a later polishing (e.g., $50^{th}$) and dividing the difference by the number of polishings between measurements. The compressibility of the pad can be measured by measuring the height of the head before and after compressing it against a polishing pad.

After initialization (1410), a substrate is placed (1420) in the head for polishing. The stopper is then positioned (1430), e.g., raised, so that when the head is lowered (1440) it is positioned to compensate for pad wear. The positioning can be calculated by subtracting the pad wear rate times the number of polishings from the original head height. After positioning (1430) the stopper, the head is lowered (1440) until the sensor assembly contacts the stopper. CMP then begins (1450) and the method 1400 ends.

The foregoing description of the illustrated embodiments of the present invention is by way of example only, and other variations and modifications of the above-described embodiments and methods are possible in light of the foregoing teaching. For example, the embodiments described herein are not intended to be exhaustive or limiting. The present invention is limited only by the following claims.

What is claimed is:

1. An adjustable chemical mechanical polishing apparatus for polishing a substrate placed on a polishing pad, comprising:

a sub carrier;

a positioning mechanism that positions the sub carrier to an initial position at a predetermined distance from the polishing pad in preparation for each polishing operation, the positioning mechanism including a pad wear determining device configured to determine wear of the polishing pad, the positioning mechanism configured to move the sub carrier from the initial position to a second position by a distance in accordance with the determined wear of the polishing pad; and a flexible member coupled to the sub carrier to form a chamber, wherein when the sub carrier is positioned at the initial position or the second position, a fluid is supplied to the chamber to provide a pressure within the chamber to press the substrate against the polishing pad.

2. The polishing apparatus of claim 1, further comprising a retaining ring capable of retaining the substrate during polishing.

3. The polishing apparatus of claim 1, further comprising a housing coupled to a diaphragm, wherein the retaining ring is coupled to the diaphragm so as to form a chamber capable of receiving a fluid that forms a downward force on the retaining ring.

4. The polishing apparatus of claim 3, wherein the pressure of the fluid that forms the downward force on the retaining ring is variable.

5. The polishing apparatus of claim 1, further comprising a pivot mechanism that is coupled to the sub carrier capable of pivoting the sub carrier so as to maintain the sub carrier level parallel to the polishing pad.

6. The polishing apparatus of claim 1, wherein the flexible member and sub carrier form a plurality of chambers capable of receiving a fluid during polishing.

7. The polishing apparatus of claim 6, wherein the pressure of the fluid in the plurality of chambers is variable.

8. The polishing apparatus of claim 1, wherein the pressure of the fluid is variable.

9. The polishing apparatus of claim 1, wherein the distance between the sub carrier and the flexible member during polishing is controlled within about 0.5 mm or less resolution.

10. The polishing apparatus of claim 1, wherein the distance between the sub carrier and the flexible member during polishing varies with the wear on the polishing pad.

11. The polishing apparatus of claim 1, further comprising a reference point on a bottom surface of the sub carrier, the reference point capable of contacting the substrate on the polishing pad and limiting the downward movement of the sub carrier so as to determine the position of the polishing pad top surface.

12. The polishing apparatus of claim 11, further comprises a soft pad on the bottom surface of the reference point.

13. The polishing apparatus of claim 12, wherein the soft pad is less compressive than the flexible member.

14. The polishing apparatus of claim 1, wherein the positioning mechanism includes a:

a bracket coupled to the sub carrier such the bracket moves along a movement path during movement of the sub carrier;

a stopper assembly including a stopper movable from a staffing position and a movement device configured to move the stopper along the movement path of the bracket; and a measuring device configured to measure a distance between the bracket and the stopper at the staffing position, wherein the movement device of the stopper assembly is configured to move the stopper from the staffing position by a distance that is greater than or equal to the measured distance between the bracket and the stopper at the starting position.

15. The polishing apparatus of claim 14, wherein the chamber formed by the flexible member and the sub carrier is defined by a vertical chamber distance between the flexible member and the sub carrier, and the movement device of the stopper assembly is configured to move the stopper from the initial position by a distance equal to the sum of the vertical chamber distance and the measured distance between the bracket and the stopper at the initial position.

16. A method of chemical mechanical polishing of a substrate against a polishing pad, the method comprising:

positioning a sub carrier in preparation for a polishing operation on a substrate using a polishing pad, the sub carrier coupled to a flexible member for carrying the substrate, and coupled to a positioning mechanism including a pad wear determining device configured to determine wear of a polishing pad, wherein the positioning of the sub carrier includes the pad wear determining device determining the wear of the polishing pad and the positioning mechanism positioning the sub carrier to a predetermined distance from the polishing pad in accordance with the determined wear of the polishing pad.

17. The method of claim 16, wherein positioning the sub carrier in preparation for the polishing operation includes moving the sub carrier from a position at which the flexible member is fully compressed against the sub carrier, the sub carrier moved by a net distance based at least on a change in polishing pad height since a previous polishing operation using the polishing pad.

18. The method of claim 17, wherein the net distance is further based at least on a compressibility parameter of the flexible member, the compressibility parameter representative of a difference in location of the sub carrier from when the flexible member is fully compressed against the sub carrier and to when the flexible member becomes uncompressed against the sub carrier.

19. The method of claim 16, wherein positioning the sub carrier in preparation for the polishing operation includes moving the sub carrier by a net distance based at least on a first factor multiplied by a second factor, the first factor representative of wear rate of the polishing pad and the second factor representative of cumulative usage of the polishing pad.

20. The method of claim 19, wherein the first factor is based at least on the quotient of a dividend and a divisor, the dividend representative of a difference in pad height between a first previous polishing operation using the polishing pad and a second previous polishing operation using the polishing pad, the divisor representative of the total number of polishing operations using the polishing pad from the first previous polishing operation to the second previous polishing operation.

21. The method of claim 20, wherein the second factor is based at least on the total number of polishing operations on the polishing pad since the first previous polishing operation.

22. The method of claim 16, further comprising:

moving a stopper to a stopper location relative to the polishing head, the stopper location based at least a wear parameter of the polishing pad and a compressibility parameter of the flexible member;

wherein positioning the sub carrier in preparation for the polishing operation includes moving the sub carrier until a member coupled to the sub carrier contacts the stopper.

23. The method of claim 22, wherein the wear parameter is associated with a change in pad height since a previous polishing operation using the polishing pad.

24. The method of claim 22, wherein the compressibility parameter corresponds to a difference in location of the sub carrier from when the flexible member is fully compressed against the sub carrier and to when the flexible member becomes uncompressed against the sub carrier.

* * * * *